US006826878B1

(12) United States Patent
Rovtar

(10) Patent No.: US 6,826,878 B1
(45) Date of Patent: Dec. 7, 2004

(54) WINDOW SHIM

(76) Inventor: John Rovtar, 45 Grand Ave. Apt. A4, Rockville Centre, NY (US) 11570

( * ) Notice: Subject to any disclaimer, the term of this patent is extended or adjusted under 35 U.S.C. 154(b) by 0 days.

(21) Appl. No.: 10/173,205

(22) Filed: Jun. 15, 2002

Related U.S. Application Data

(60) Provisional application No. 60/302,032, filed on Jun. 28, 2001.

(51) Int. Cl.[7] ..... E06B 1/04

(52) U.S. Cl. ..... 52/213; 52/217; 52/204.1; 52/204.591; 411/383; 411/546

(58) Field of Search ..... 52/213, 217, 204.1, 52/204.591, 745.16, 745.2; 411/383, 384, 535, 546

(56) References Cited

U.S. PATENT DOCUMENTS

| | | | | |
|---|---|---|---|---|
| 1,891,588 A | | 12/1932 | Claus | |
| 2,211,374 A | | 8/1940 | Fuss | |
| 2,722,974 A | | 11/1955 | Stagner | |
| 2,766,858 A | | 10/1956 | Johnson et al. | |
| 3,566,559 A | | 3/1971 | Dickson | |
| 3,645,054 A | | 2/1972 | Olvera | |
| 4,108,407 A | * | 8/1978 | Cable et al. | 248/656 |
| 4,120,124 A | | 10/1978 | Temple et al. | |
| 4,397,124 A | | 8/1983 | Redman | |
| 4,481,743 A | | 11/1984 | Jellen | |
| 5,174,703 A | * | 12/1992 | White | 411/107 |
| 5,340,258 A | * | 8/1994 | Simon | 411/535 |
| 5,525,001 A | * | 6/1996 | Perkins | 403/157 |
| 5,934,031 A | * | 8/1999 | deNormand | 52/204.5 |
| 6,044,611 A | * | 4/2000 | Brunett | 52/656.5 |
| 6,173,541 B1 | * | 1/2001 | Petta | 52/204.5 |
| 6,357,953 B1 | * | 3/2002 | Ballantyne | 403/43 |

FOREIGN PATENT DOCUMENTS

EP 534001 A1 * 3/1993 ..... F16B/1/00

OTHER PUBLICATIONS

PUb. No. US 2002/0095885 A1 Jul. 25, 2002 Kenneth E. Sampson.*

* cited by examiner

*Primary Examiner*—Carl D. Friedman
*Assistant Examiner*—Nahid Amiri
(74) *Attorney, Agent, or Firm*—Robert A. Seemann

(57) ABSTRACT

A threaded collar is rotatably, axially extended to the inner surface of an opening in a wall for receiving a window, from a collar that is fixedly mounted in the window's jamb, and the rotatable collar is fastened to the inner surface by a screw that extends axially through the rotatable collar.

8 Claims, 5 Drawing Sheets

WINDOW SHIM

This application claims the benefit of U.S. Provisional Application No. 60/302,032, filed Jun. 28, 2001.

BACKGROUND OF THE INVENTION

1. Field of the Invention

The invention pertains to positioning one frame within another frame, for example positioning a window between wall studs, a door frame between wall studs, and any frame having sides that are to be spaced from support elements wherein the sides are not to be bowed by the process or item of spacing from the support elements such as being bowed by a shim or by a fastener tightening a side to the support element.

The invention is described herein by way of example and not limitation, as shimming laterally from, and fastening the sides of a window to, the sides or studs of an opening through a wall.

2. Description of the Prior Art

Customarily a window is installed in an opening through a wall by first resting the window on one or more support shims that are between the sill of the window and the sill of the opening. The thickness of the support shim is selected so that the window is at a desired height between the opening's sill and the header of the opening. Then the window is positioned laterally or horizontally so that it is at a desired position between the vertical sides or studs of the opening. Screws are then placed horizontally through each vertical side or jamb of the window and screwed into the adjacent wall stud.

The screws' heads pull outward on the window jamb causing it to bow outward toward the stud into the space between the jamb and the stud. The bowing outward prevents the weather stripping seals from remaining in uniform contact along their length with the sashes.

Wood shims are inserted into the space between the jamb and the stud to reduce outward bowing of the jamb. It is difficult to maintain a balance between the bow outward force applied by the screws' heads and the bow inward force applied by the shims against the jamb.

It is time consuming to install the shims between the jamb and the stud if the stud surface is irregular. The shim cannot be inserted axially or normal to the plane of the window, into the space between the jamb and the stud, if the wallboard around the opening extends marginally past the stud over the space between the stud and the jamb, unless the wallboard is trimmed back to the stud.

U.S. Pat. No. 4,397,124, patented Aug. 9, 1983 by R. E. Redman describes a nylon thumb screw having a threaded shank, knurled disk head, and raised annular ring on the top of the head. The shank is screwed into a hole that is through a wall of the stile of a glass-retaining door panel, that is transverse to the plane of the glass. The screw is turned by the knurls until the annular ring on the head presses on an edge of the glass so that the edge is the glass pane is positioned with respect to the stile to being at a desired distance from the transverse wall of the stile. The nylon ring yields enough to the edge of the glass to dent the ring so that the glass prevents unwanted rotational movement of the screw after a desired setting adjustment is made.

SUMMARY OF THE INVENTION

It is one object of the invention to provide a shim for positioning a window between sides of an opening through a wall.

It is another object of the invention to provide a shim that positions a window from, and fastens the window to, a side of an opening through a wall.

It is another object of the invention that the shim moves laterally to an axis that is normal to the plane of the window, into the space between the jamb of the window and the side of the opening.

It is another object that the shim is mounted on the window before the shim is extended into the space between the jamb and the side of the opening.

Other objects and advantages will become apparent to one reading the ensuing description of the invention.

A shim for mounting in a passageway through a longitudinal side wall of a window frame for positioning a window adjacent to an inner surface of an opening in a wall for receiving the window, includes a first collar having an axis, means on the first collar for preventing rotation of the first collar on the axis when the first collar is mounted in the passageway with the axis extending laterally to the length of the side wall, a second collar mounted in the first collar, means on the first and second collars for moving the second collar axially within the first collar by rotating the second collar so that a first end of the second collar can be extended away from the longitudinal side wall and the window frame, and means on the second collar for receiving a fastener for fastening the second collar to the inner surface of the second opening when the window is in the opening and the first collar is mounted in the passageway.

The means on the second collar for receiving a fastener includes a channel that extends axially through the second collar. The means for moving the second collar axially within the first collar includes a thread.

A method of positioning a window in an opening through a wall includes the steps of positioning the window in the opening so that a longitudinal side of the frame of the window is adjacent to an inner side of the wall's opening, rotating a hollow shaft threadedly mounted in a collar that is mounted on the frame against rotation of the collar, until a first end of the shaft contacts the inner side of the wall when the longitudinal side is the desired distance from the inner side of the wall for positioning the window in the opening, and applying force toward the inner side against a second end of the hollow shaft by extending a fastener through the hollow shaft into the inner side of the wall.

A method for fastening a window in an opening through a wall comprising a first side that faces into the opening, includes the steps of:

in any order, (a) positioning the window in the opening so that a longitudinal side of the frame of the window is adjacent to the first side, (b) rotating a shaft comprising a longitudinal passageway therethrough, on external threads on the shaft which engage internal threads on a collar that is mounted on the longitudinal side of the frame against rotation of the collar, so that a first end of the shaft contacts the first side of the wall when the longitudinal side of the frame is a desired distance from the front side of the wall for positioning the window in the opening, and then (c) while the first end of the shaft is in contact with the first side of the wall, press a fastener that extends through the passageway, against a second end of the shaft by driving a first end of the fastener into the wall, so that lateral force is not delivered to the longitudinal side of the window frame by the shaft.

A method for mounting a window frame in an opening through a wall comprising a first side that faces into the opening, comprising the steps of:

in any order, (a) positioning the window in the opening so that a longitudinal side of the frame is adjacent to the first side, (b) rotating a hollow shaft on external threads on the shaft which engage internal threads on a collar that is mounted on the frame against rotation of the collar, so that a first end of the shaft contacts the first side of the wall when the longitudinal side is a desired distance from the first side of the wall for positioning the window in the opening, and then one of (c) with a portion of a fastener against a second end of the hollow shaft, applying force toward the first side against the second end of the hollow shaft by extending the fastener which passes through the hollow shaft into the first side of the wall, (d) applying force toward the first side of the wall against a second end of the hollow shaft with a fastener that extends through the hollow shaft, and fastening the fastener to the wall, and (e) fastening the first end of the shaft against the first side that faces into the opening.

A window mounted in an opening in a wall having a first side, includes:

a frame of said window comprising a longitudinal side wall, said first side of said wall facing into said opening, adjacent to and spaced from said longitudinal side wall, a collar, mounted in said longitudinal side wall against rotation in said longitudinal side wall, having an axis transverse to said longitudinal side wall, a shaft comprising a longitudinal passageway therethrough, mounted in said collar, external threads on said shaft engaging internal threads on said collar, said shaft extending from said collar toward said first side, a first end of said shaft contacting said first side, and one of (a) a fastener contacting a second end of said shaft, extending through said passageway into said first side for fastening the first end of said shaft against said first side facing into said opening, and (b) a fastener, comprising a portion fixedly larger than the diameter of said longitudinal passageway at a second end of said shaft engaging said second end of said shaft, extending through said passageway, fastened to said wall.

A shim for mounting in a hole through a longitudinal side wall having a front surface and a back surface, of a widow frame for attaching the frame to a surface of a second wall defining an opening in the second wall for receiving the window frame in the second wall, includes:

a first collar having an axis, first means on said first collar, extending radially from said first collar for engaging the front surface and the back surface of said longitudinal side wall when said first collar is mounted in the opening with said axis extending laterally to the length of said longitudinal side wall, a second collar comprising a longitudinal passage therethrough, mounted in said first collar, threads on the first and second collars for moving said second collar axially within said first collar by rotating said second collar so that a first end of said second collar can be extended from the window frame, a fastener comprising a portion adjacent to a second end of said second collar, fixedly larger than the diameter of said longitudinal passageway at said second end of said second collar, extending through said passageway, a portion of said fastener adapted for fastening in said second wall by penetrating said second wall extending from the first end of said second collar. The shim may also include second means on said first collar, extending radially from said first collar configured for engaging said longitudinal side wall for preventing rotation of said first collar on said first axis when said first collar is mounted in the opening with said axis extending laterally to the length of said longitudinal side wall.

Other objects and advantages will be apparent to one reading the ensuing description of the invention.

BRIEF DESCRIPTION OF THE DRAWINGS

In order that the invention be more fully comprehended, it will now be described, by way of example, with reference to the accompanying drawings, in which.

DESCRIPTION OF THE PREFERRED EMBODIMENTS

Figure 1:
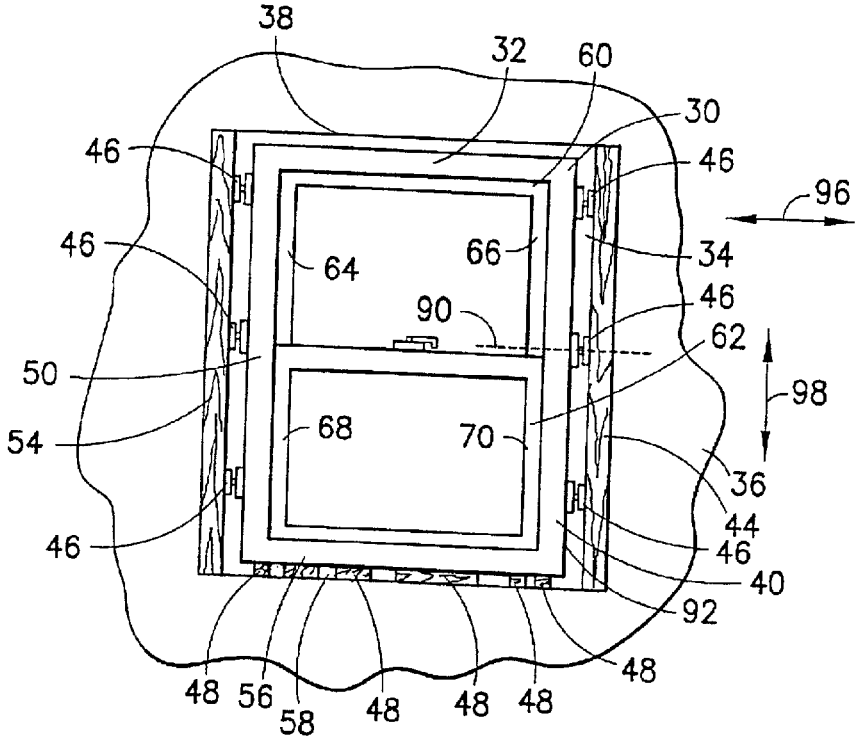
FIG. 1 is a schematic front view of a window mounted by the invention between studs of an opening through a wall.

Before explaining the invention in detail, it is to be understood that the invention is not limited in its application to the detail of construction and arrangement of parts illustrated in the drawings since the invention is capable of other embodiments and of being practiced or carried out in various ways. It is also to be understood that the phraseology or terminology employed is for the purpose of description only and not of limitation.

In FIG. 1, window 30 is mounted in opening 34 of wall 36. Jamb 40 is spaced from, and attached to stud 44 by shims 46. Jamb 50 is spaced from, and attached to stud 54 by shims 46. Sashes 60 and 62 slide by their respective stiles 64, 66 and 68, 70 up and down in jambs 40 and 50.

Head 32 of the window is spaced from header 38 of the opening. Two or more wooden shims 48 space sill 56 of the window from sill 58 of the opening, and support the window in the opening while shims 46 are adjusted for lateral positioning of the window in the opening.

Figure 2:
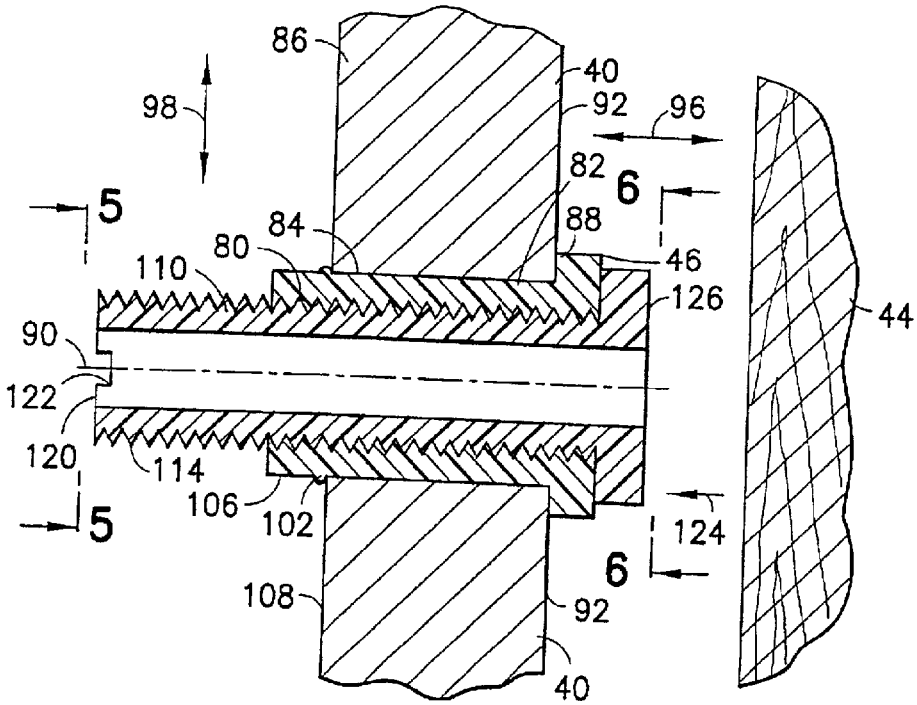
FIG. 2 is a schematic cross section view of a shim of the invention mounted in a window jamb that is adjacent to and spaced from a stud of an opening through a wall.

In FIG. 2, internally threaded 80 collar 82 of shim 46 is mounted in opening 84 that is through outer wall 86 of jamb 40. The axis 90 of collar 82 extends laterally 96 to length 98 of jamb 40. Collar 82 is mounted in wall 86 against rotation of collar 82 on axis 90. Raised annular ridge 102 on outer surface 106 provides a tight fit of collar 82 in opening 84 sufficient to prevent rotation of the collar in the hole. There is sufficient flexibility between the combination of wall 86 and collar 82 so that the collar can be pressed into the hole from outer side 92 of outer wall 86 of jamb 40 until when head 88 is seated against outer side 92 of wall 86, ridge 102 snaps behind inner side 108 of wall 86.

Another way to prevent rotation of collar 82 on axis 90 is to provide a radial slot and radial ridge, one each on wall 86 and collar 82, so that the ridge is received in the slot when the collar is in the wall. Preferably collar 82 is plastic, molded in one piece. Other ways may be used to prevent rotation of collar 82 in wall 40, including glue.

Collar 110 of shim 46 is moved laterally 96 by rotating collar 110 clockwise or counterclockwise around axis 90 while external threads 114 on collar 110 are in engagement with internal threads 80 on collar 82. Preferably collar 110 is plastic, molded in one piece.

Jamb 40 can be conventional, for example, an extrusion having a plurality of longitudinal parallel walls.

Walls which cross axis 90 have openings through them for access to driver end 120 of collar 110 to rotate the collar.

Driver end 120 is turned by a screw driver or hex key in complementary receiver 122 or any other tool that can be used to turn driver end 120.

Also in FIG. 2, collar 110 is screwed inward 124 into collar 82 until head 126 is moved as close as possible to outer side 92, which is against bead 88. When each collar 110 is screwed inward, close as possible to the outer side of the jamb, they provide clearance between the jambs and the respective studs to insert the window into the wall, clear of the studs and clear of wall board that may extend inward past the inner face of a stud.

Figure 3:
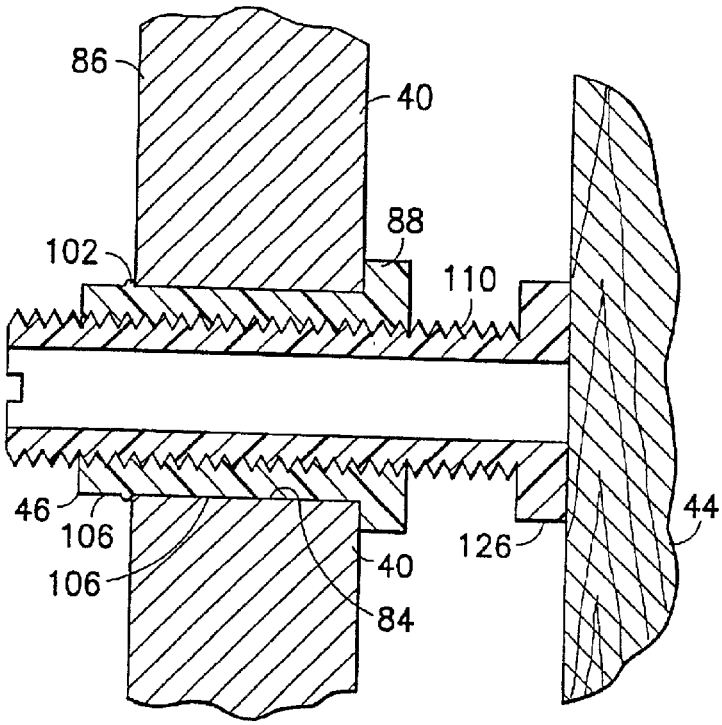
FIG. 3 is a schematic cross section view of the shim of FIG. 2 extended laterally from the jamb, in contact with the stud so that the shim positions the jamb laterally relative to the stud.

In FIG. 3, collar 110 is screwed outward until head 126 is in contact with stud 44. This operation is done for each shim 46 in FIG. 1. Each shim is screwed out a sufficient amount so that when jambs 40 and 50 are each a desired distance from the respective adjacent studs, each head is in contact with the stud. Collars 110 are screwed out enough to make the head snug against the stud, but not so hard so as to bend or bow the jamb.

Figure 4:
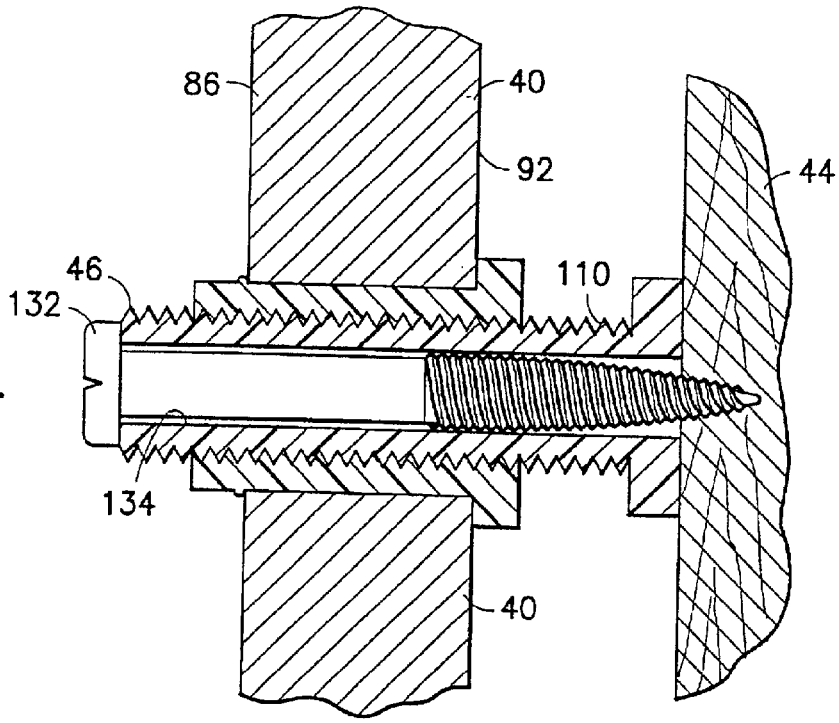
FIG. 4 is a schematic cross section view of the shim of FIG. 3 as positioned in FIG. 3, fastened to the stud by a screw.
Figure 5:
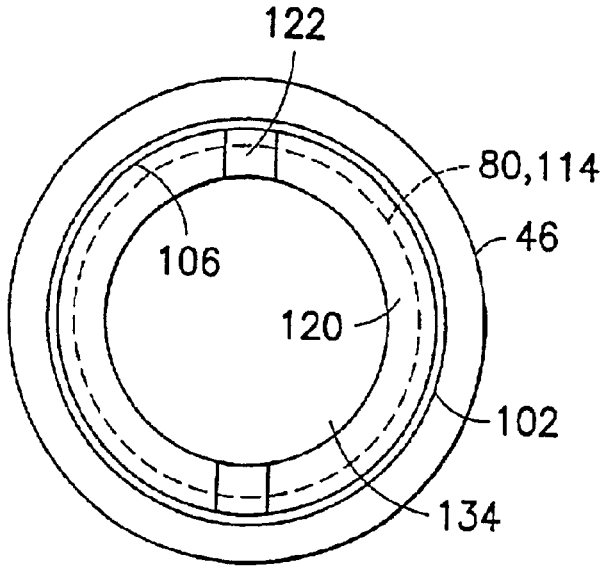
FIG. 5 is a side view of the shim of FIG. 2, less the stud and jamb, taken at 5—5
Figure 6:
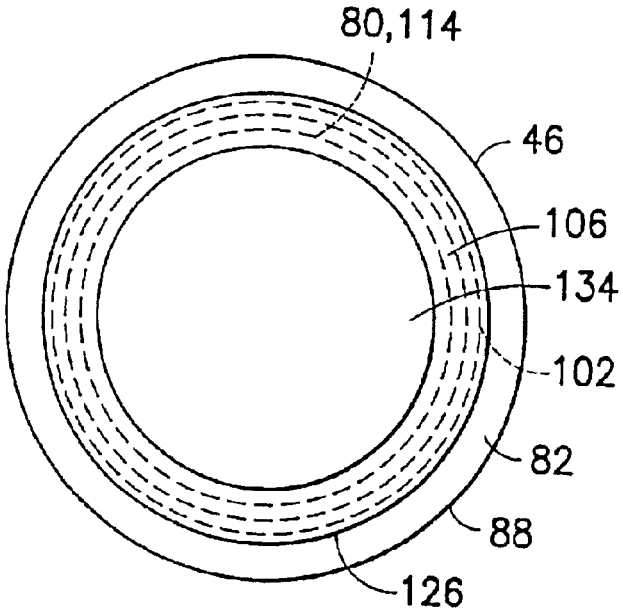
FIG. 6 is a side view of the shim of FIG. 2, less the stud and jamb, taken at 6—6.

In FIG. 4, with collar 110 screwed out as in FIG. 3, screw fastener 132 is inserted into channel 134 in collar 110 and screwed into stud 44. The head of fastener 132 is resting on the driver end of collar 110. Screw 132 can be driven as hard as desired so long as it does not bend or break collar 110, without fear of bowing outer wall 86 of the jamb because the screw does not bear laterally upon the jamb. In fact, for that reason, a nail can be used instead of a screw, hammered in without concern about bowing the jamb. The head of collar 110 is not shown in FIG. 5 for clarity of viewing.

Figure 7:
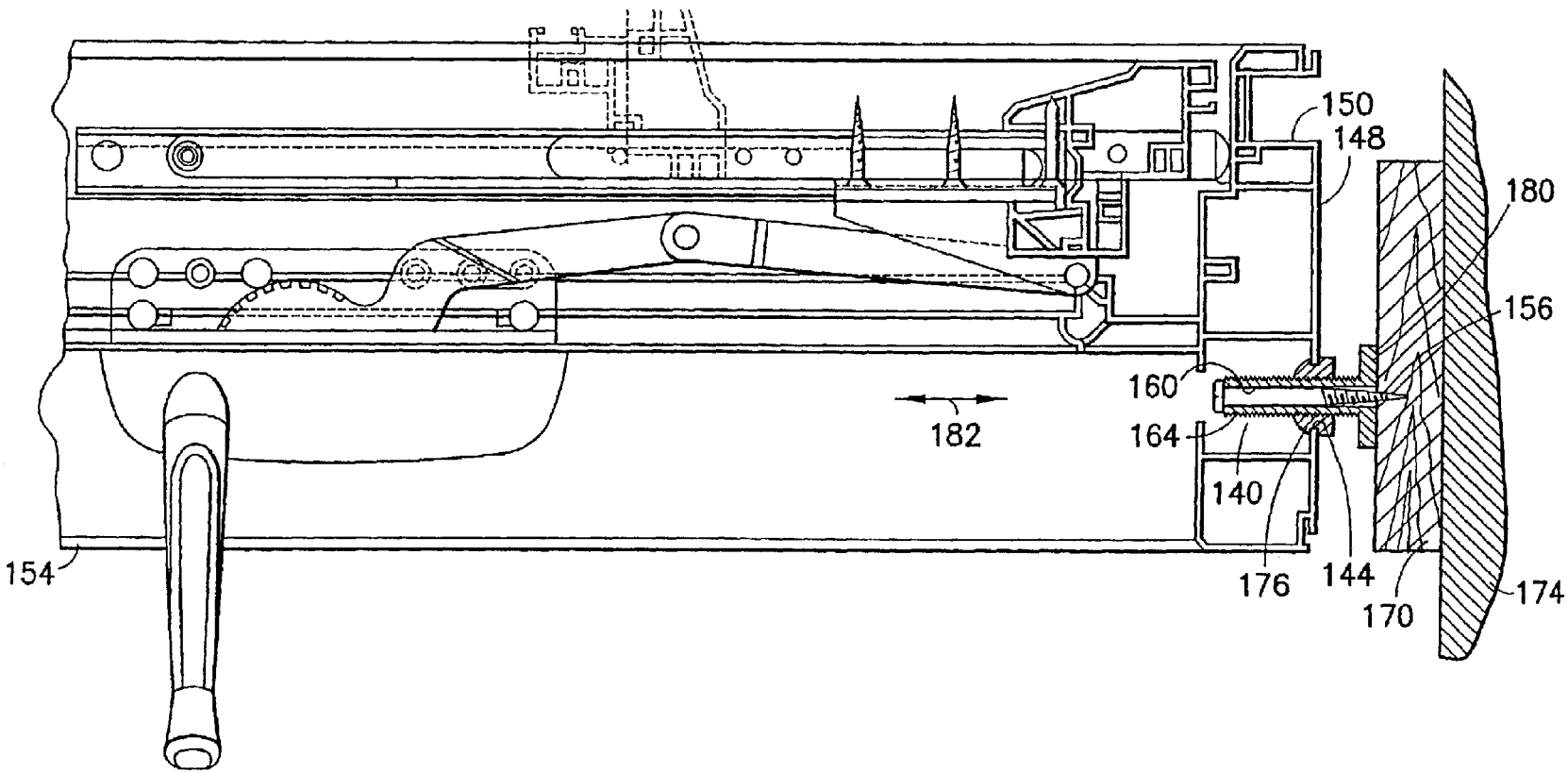
FIG. 7 is a schematic partial cross section view of a crank operated window spaced from and attached to a wall stud by a shim of the invention.

In FIG. 7, shim 140 is mounted in opening 144 in outer wall 148 of jamb extrusion 150 of window frame 154. Screw 156 extends through channel 160 in externally threaded collar 164 into wood stud 170 of building wall 174. Collar 164 is screwed into internally threaded collar 176 which is mounted on outer wall 148 so that collar 176 cannot rotate in opening 144. End 180 of collar 164 is in contact with stud 170. Screw 156 attaches collar 164 to stud 170. Collar 164 cannot rotate of its own accord when fastened to stud 170, and remains fixed by the threads against axial movement 182 with respect to collar 176 within collar 176.

Figure 8:
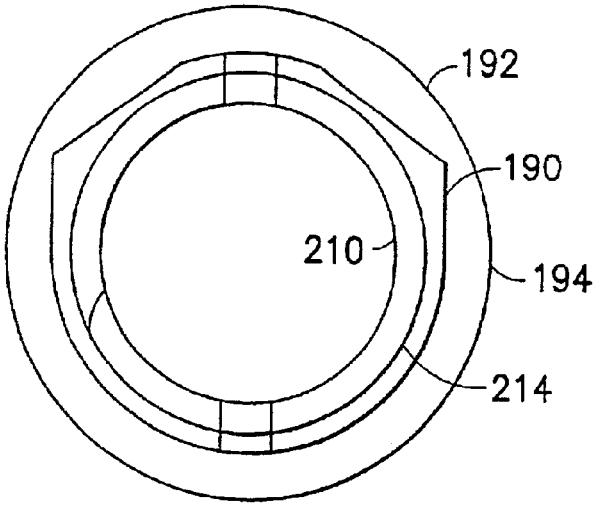
FIG. 8 is a side view of another shim of the invention taken from the driver end.
Figure 9:
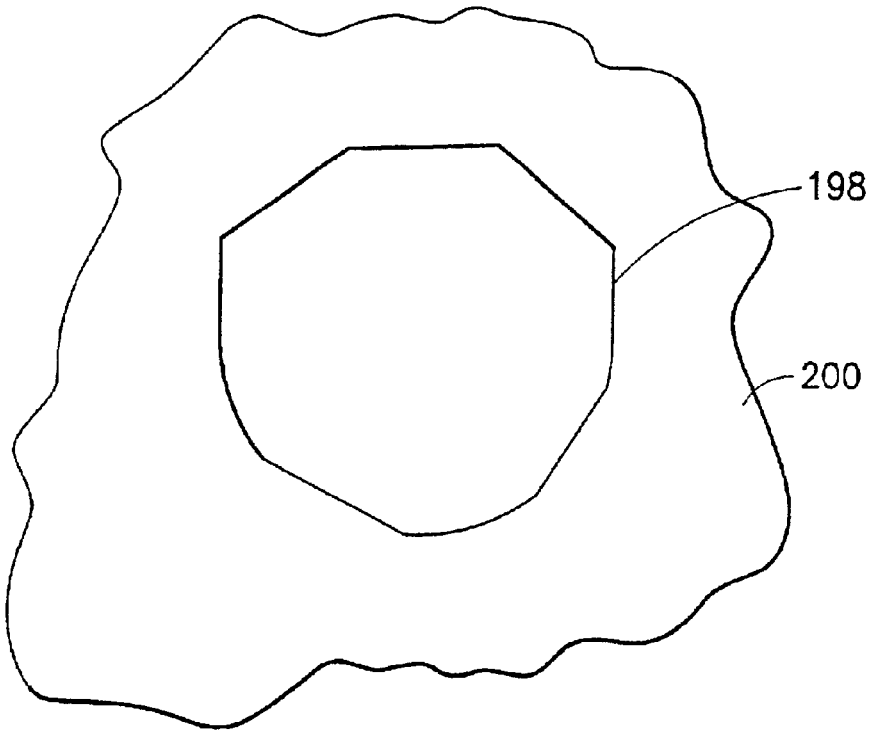
FIG. 9 is a side view of an opening in a window jamb, for receiving the shim of FIG. 8.

In FIGS. 8 and 9, outer wall 190 of collar 194 of shim 192 is shaped irregular or non-circular, designed to fit irregular or non-circular opening 198 in jamb 200 so that the fit prevents rotation of collar 194 when collar 194 is mounted in opening 198. Collar 210 rotates within collar 194 on threads 214. The head of collar 210 is not shown for clarity of viewing.

The shim of the invention can be used to position a wood or plastic frame adjacent to a support. The frame can be provided with a smooth hole for receiving the outer collar which may have protrusions that grip the smooth inner surface of the hole to prevent rotation of the outer collar in the hole.

The lengths and diameters of the outer collar and the inner collar that moves axially within the outer collar on threads between the inner and outer collar of the invention's shim may be any practical size for their intended use. They are preferably constructed so that the shim fits the frame wall that is being positioned adjacent to a support wall and can adjust to bridge the range of space that will be encountered between the frame wall and the support wall.

Although the present invention has been described with respect to details of certain embodiments thereof, it is not intended that such details be limitations upon the scope of the invention. It will be obvious to those skilled in the art that various modifications and substitutions may be made without departing from the spirit and scope of the invention as set forth in the following claims.

Drawing Designators (Informal List)

30 window
32 head
34 opening
36 wall
38 header
40 jamb
44 stud
46 shim
48 shim, wooden
50 jamb
54 stud
56 sill of the window
58 sill of the opening
60 sash
62 sash
64 stile
66 stile
68 stile
70 stile
80 internal threads on collar 82
82 collar
84 opening
86 outer wall of jamb 40
88 head
90 axis
92 outer side of wall 86
96 laterally, direction arrow
98 length, direction arrow
102 raised annular ridge
106 outer surface
108 inner side of wall 86
110 collar
114 external threads on collar 110
120 driver end of collar 110
122 receiver
124 inward, direction arrow
126 head
132 screw fastener
134 channel
140 shim
144 opening
148 outer wall of jamb extrusion 150
150 jamb extrusion
154 window frame
156 screw
160 channel
164 collar, externally threaded
170 stud
174 building wall
176 collar, internally threaded
180 end of collar 164

182 axial movement, direction arrow
190 outer wall
192 shim
194 collar
198 opening
200 jamb
210 collar
214 threads

What is claimed is:

1. A window mounted between a first stud and a second stud defining sides of an opening in a wall, comprising:

a frame of said window having a plane comprising a longitudinal side wall extending along said plane, adjacent to and spaced from said first stud, a first collar, mounted in said longitudinal side wall against rotation in said longitudinal side wall, having an axis transverse to said longitudinal side wall extending through said side wall along said plane, a second collar comprising a longitudinal passageway extending along said axis through said second collar, mounted in said first collar, external threads on said second collar engaging internal threads on said first collar, said second collar extending from said first collar toward said first stud, a first open end of said second collar contacting said first stud, a fastener extending radially over a second end of said second collar, extending through said passageway, a portion of said fastener adapted for fastening in said first stud by penetrating said first stud, extending into said first stud fastening said first open end of said second collar against said first stud, forming with said first collar an annular shim on said axis preventing movement of said side wall along said axis.

2. A window mounted between a first member and a second member defining sides of an opening in a wall, comprising:

a frame of said window having a plane comprising a longitudinal side wall extending along said plane, adjacent to and spaced from said first member, a first collar, mounted in said longitudinal side wall against rotation in said longitudinal side wall, having an axis transverse to said longitudinal side wall extending through said side wall along said plane, a second collar comprising a longitudinal passageway extending along said axis through said second collar, mounted in said first collar, external threads on said second collar engaging internal threads on said first collar, said second collar extending from said first collar toward said first member, a first open end of said second collar contacting said first member, a fastener adapted for fastening in said first member by penetrating said first member, comprising a first portion fixedly larger than the diameter of said longitudinal passageway at a second end of said second collar extending radially over said second end of said second collar, said fastener extending through said passageway into said first member fastening said first open end of said second collar against said first member, forming with said first collar an annular shim on said axis preventing movement of said side wall along said axis.

3. A window mounted between a first stud and a second stud defining sides of an opening in a wall, comprising:

a frame of said window having a plane comprising a longitudinal side wall extending along said plane, adjacent to and spaced from said first stud, a hole through said side wall having a first diameter, a first collar comprising a first radially extending portion larger than said hole and a second radially extending portion larger than said hole spaced from said first radially extending portion, there being sufficient flexibility between the combination of side wall and first collar for pressing said first radially extending portion through said hole, said first collar mounted in said hole against rotation in said longitudinal sidewall, having an axis transverse to said longitudinal side wall extending through said side wall along said plane, a second collar comprising a longitudinal passageway extending along said axis through said second collar, mounted in said first collar, external threads on said second collar engaging internal threads on said first collar, said second collar extending from said first collar toward said first stud, a first open end of said second collar contacting said first stud, a fastener extending radially over a second end of said second collar, extending through said passageway, a first portion of said fastener adapted for fastening in said first stud by penetrating said first stud, extending into said first stud fastening said first open end of said second collar against said first stud, forming with said first collar an annular shim on said axis preventing movement of said side wall along said axis.

4. A window mounted between a first member and a second member defining sides of an opening in a wall, comprising:

a frame of said window having a plane comprising a longitudinal side wall extending along said plane, adjacent to and spaced from said first member, a hole through said side wall having a first diameter, a first collar comprising a first radially extending portion larger than said hole and a second radially extending portion larger than said hole spaced from said first radially extending portion, there being sufficient flexibility between the combination of side wall and first collar for pressing said first radially extending portion through said hole, said first collar mounted in said hole, having an axis transverse to said longitudinal side wall extending through said side wall along said plane, a second collar comprising a longitudinal passageway extending along said axis through said second collar, mounted in said first collar, external threads on said second collar engaging internal threads on said first collar, said second collar extending from said first collar toward said first member, a first open end of said second collar contacting said first member, a fastener adapted for fastening in said first member by penetrating said first member, comprising a first portion fixedly larger than the diameter of said longitudinal passageway at a second end of said second collar extending radially over said second end of said second collar, said fastener extending through said passageway into said first member fastening said first open end of said second collar against said first member, forming with said first collar an annular shim on said axis preventing movement of said side wall along said axis.

5. The window of claim 2 further comprising:

a transverse axial depression in a generally planar surface of said second end of said second collar for receiving a tool for turning said collar, said first portion resting on said planar surface, extending over said depression.

6. The window of claim 4 further comprising:

a transverse axial depression in a generally planar surface of said second end of said second collar for receiving a tool for turning said collar, said first portion resting on said planar surface, extending over said depression.

7. The window of claim 1 further comprising:

the portion of said fasteners extending over said second end of said second collar axially contacting said second end.

8. The window of claim 2, further comprising:

a portion of said fastener extending over said second end of said second collar axially contacting said second end.

* * * * *